United States Patent [19]

Imazeki et al.

[11] Patent Number: 4,523,197

[45] Date of Patent: Jun. 11, 1985

[54] ANTENNA WITH BNC-TYPE COAXIAL CONNECTOR

[75] Inventors: Kazuyoshi Imazeki; Nobuaki Yokoyama, both of Tokyo, Japan

[73] Assignee: General Research of Electronics, Inc., Tokyo, Japan

[21] Appl. No.: 471,892

[22] Filed: Mar. 3, 1983

[51] Int. Cl.[3] ..... H01Q 1/50

[52] U.S. Cl. ..... 343/702; 343/906; 343/901

[58] Field of Search ..... 343/702, 906, 901, 904, 343/905; 174/153 A; 455/89, 90, 99

[56] References Cited

U.S. PATENT DOCUMENTS

| | | | |
|---|---|---|---|
| 3,296,620 | 1/1967 | Rodda | 343/906 |
| 3,702,480 | 11/1972 | Byars | 343/715 |
| 4,090,030 | 5/1978 | Lagasse | 343/906 |

*Primary Examiner*—Eli Lieberman

*Attorney, Agent, or Firm*—Trexler, Bushnell & Wolters

[57] ABSTRACT

An antenna comprises an antenna body telescopically movable between a fully retracted position and a fully extended position and having a free end. A BNC-type coaxial receptacle is mounted to the free end of the antenna body. A mounting base receives the BNC-type coaxial receptacle when the antenna is in the fully retracted and completes an electrical ground circuit to the BNC-type receptacle.

5 Claims, 2 Drawing Figures

ANTENNA WITH BNC-TYPE COAXIAL CONNECTOR

BACKGROUND OF THE INVENTION

This invention relates generally to telescoping, rod-type antennas, and more particularly a device for enabling such an antenna, mounted to a portable radio set or the like, to connect with an external coaxial BNC-type connector.

Portable radio sets are generally provided with a telescoping antenna which is both retractable into the radio case or housing and extendable therefrom. It is often desirable to electrically connect the radio input which normally receives signals from this antenna to another, external antenna or to an external connector from a test apparatus.

Such electrical connection may be provided independently of the antenna itself, by mounting a suitable jack or other connector to the radio housing and providing suitable leads from this jack or other connector to the desired input of the radio in common with the inputs thereto from the antenna. However, when a telescoping antenna is utilized, it is necessary to first fully retract the telescoping antenna before utilizing such an auxiliary jack, to prevent interference from signals which would otherwise be picked up by the extended antenna.

Advantageously, the present invention provides such an auxiliary jack as a part of the antenna itself, eliminating the extra expense of providing such an auxiliary jack or other connector, the mounting thereof to the radio housing or casing and the interconnection of leads therefrom to the radio inputs. Moreover, the invention provides such a connector which is adapted to accept an external cable or other connection only when the antenna is in the fully retracted position, thus automatically eliminating any problem of interference from the antenna itself.

Accordingly, it is an object of this invention to provide means for connecting a telescoping antenna of a radio set to an external BNC-type coaxial cable connector.

In accordance with one embodiment of this invention, the free outer end of the telescoping antenna and an antenna mount base together form a BNC-type coaxial female connector or receptacle.

BRIEF DESCRIPTION OF THE DRAWINGS

The foregoing as well as other objects, features and advantages of the invention will be more readily appreciated upon reading the following detailed description of the illustrated embodiment together with reference to the drawings, wherein.

DETAILED DESCRIPTION OF THE ILLUSTRATED EMBODIMENT

Figure 1:
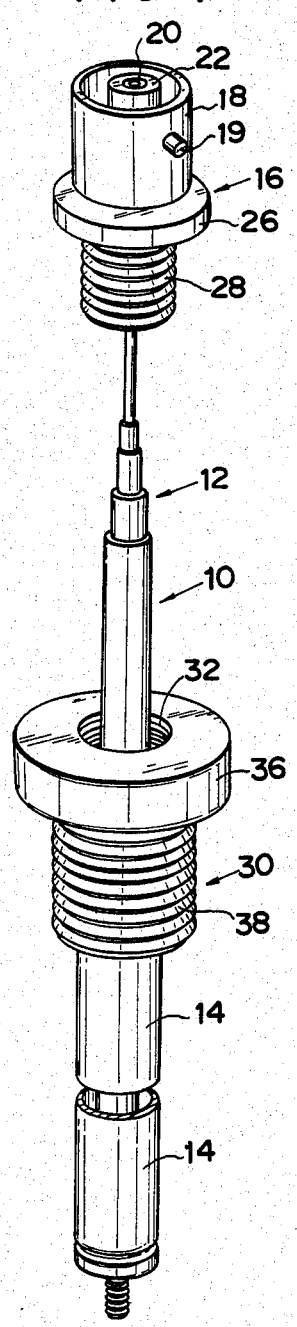
FIG. 1 is a perspective view of an antenna constructed according to this invention, shown in a partially extended position.

Referring now to the drawings, and initially to FIG. 1, an antenna 10 comprises a telescoping antenna body 12 which is coaxially mounted to a cylindrical base 14 so as to be telescopically retractable and extendable with respect thereto. Preferably this base 14 is mounted within the casing or housing (not shown) of a radio. The antenna body 12 preferably comprises a plurality of coaxially arranged metallic tubes which can be readily extended to a desired length to act as an antenna.

When the telescoping antenna body 12 is fully retracted with respect to the base 14, it serves as the female or receptacle unit of a BNC-type coaxial connector. In this regard, the axially outer or free end 24 of the telescoping antenna body 12 mounts such as BNC-type receptacle 16. This receptacle 16 includes a cylindrical metallic inner electrode 20 having an axial bore 21 adapted to receive the center electrode of a conventional BNC-type coaxial connector male unit or jack (not shown). A plastic tubular insulating member 22 surrounds the cylindrical electrode 20.

Figure 2:
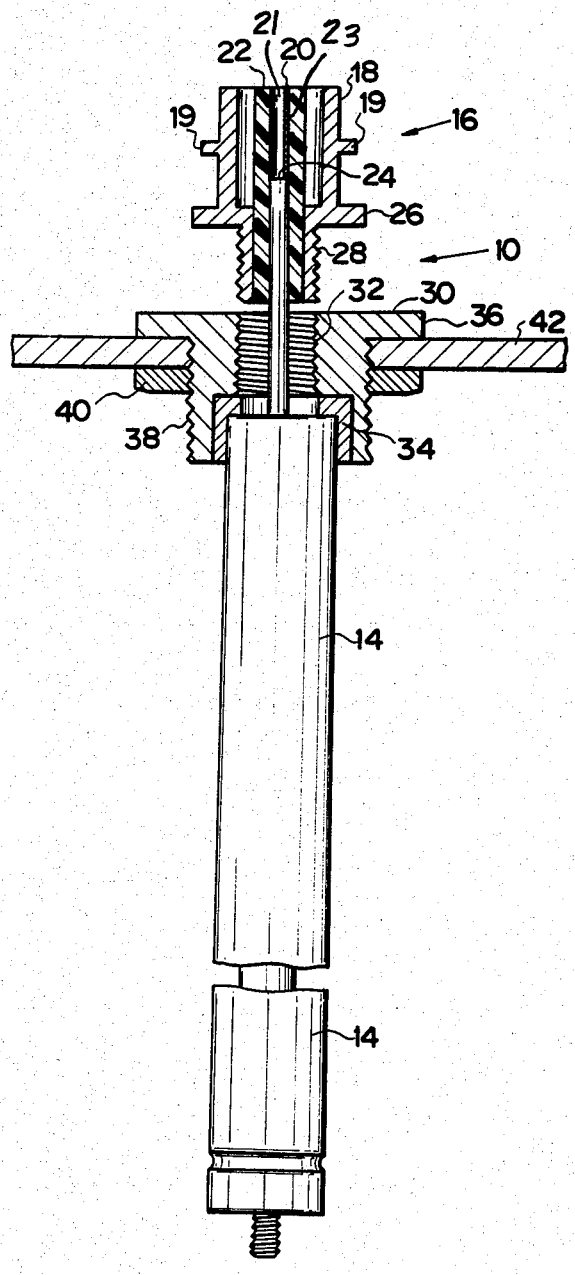
FIG. 2 is a side elevation, partially in section, of the antenna of FIG. 1 in partially retracted position and mounted to the casing of a radio, for example.

As best shown in FIG. 2, the cylindrical electrode 20 is coupled with the axially outer or free end 24 of the telescoping antenna body 12 by suitable means. In the illustrated embodiment, this coupling is achieved by sizing the inner diameter 23 of the tubular insulating member 22 to receive both the electrode 20 and the axially outer end 24 of the antenna body 12 in mutual electrical contact, for example by a press fit.

The remaining portion of a coaxial connector receptacle unit 16 is defined by an outer metallic electrode member 18. The insulating sleeve 22 is coaxially mounted inside of this outer electrode 18. Advantageously, this outer electrode member 18 comprises a generally cylindrical metallic member having a pair of bayonet pins 19 to form the outer or grounding portion of a typical BNC-type coaxial connector receptacle. Additionally, a radially outwardly extending circular flange portion 26 of this outer electrode 18 defines the full advancement of a mating BNC-type male connector or jack unit with respect thereto.

In accordance with a further feature of the invention, the outer electrode 18 also includes, at its axially innermost end, an externally threaded portion 28. This externally threaded portion 28 advantageously threadably mates with or engages a complimentary threaded portion in a radio housing or casing, to complete a ground circuit to the electrode 18.

In the illustrated embodiment, such a coupling is preferably provided by a mounting member 30 which serves to mount the antenna 10 with a wall 42 or other external surface of such radio housing or casing. In this regard, the mounting member 30 comprises a generally cylindrical body having an internally threaded, axial through bore 32 for threadably receiving the threads 28 of the electrode 18. The cylindrical body 30 also includes an axially outer flange portion 36 for engaging a top surface of the wall 42 or other radio surface and an external threaded 38 insertable through a suitable aperture in this wall 42. Preferably an additional mounting component such as a nut 40 is provided for threadable advancement with respect to the outer thread 38 and abutment with the inner surface of the wall 42 to securely hold the mounting member 30 in place with respect thereto.

In order to secure the antenna 10 with respect to the wall 42 of the radio casing or housing, the mounting member 30 also includes an inner tubular insulator sleeve 34. This sleeve 34 is preferably of lesser inner diameter than the internal thread 32 and is received in a press fit or by other suitable means coaxially within the outer thread 38. The inner diameter of this latter sleeve 34, or at least a portion thereof, is sized to receive the cylindrical antenna base, or at least a portion thereof, in a press fit.

In operation, it will be seen that a BNC-type coaxial connector receptacle unit 16 is provided at an outer end of the antenna body 12. However, this receptacle 16 remains ineffective until the antenna is fully retracted and the threaded portion 28 of the outer electrode 18 is threadably engaged with the inner thread 32 of the mounting member 30. When this operation is accomplished, the ground circuit to the outer electrode 18 from the radio (which has a conventionally grounded radio housing) is completed and the connector 16 becomes operative.

The invention has been illustrated and described hereinabove with reference to a preferred embodiment, however, the invention is not limited thereto. Those skilled in the art may devise various alternatives, changes and modifications upon reading the foregoing description. The invention includes such alternatives, changes and modifications insofar as they fall within the spirit and scope of the appended claims.

The invention is claimed as follows:

1. An antenna comprising: an antenna body telescopically extendable from a fully retracted position and having a free end; a BNC-type coaxial receptacle member mounted to the free end of said antenna body, said receptacle member including a tubular, electrically conductive inner electrode electrically coupled with the antenna body and defining an axial bore and a tubular, electrically conductive outer electrode coaxially surrounding said inner electrode; base means for mounting said antenna body to a radio, said base means including a cylindrical portion for telescopically mounting said antenna body and a receptacle portion for receiving said outer electrode member when the antenna body is in said fully retracted position; said outer electrode and said receptacle portion of said base means being in electrically conductive contact when said antenna body is in said fully retracted position so as to electrically ground said outer electrode.

2. An antenna according to claim 1 and further including a tubular insulator member in surrounding engagement with said inner electrode.

3. An antenna comprising: an antenna body telescopically movable between a fully retracted position and a fully extended position and having a free end; a BNC-type coaxial receptacle mounted to the free end of said antenna body; and means for mounting said antenna body to a radio, said mounting means including means for receiving said BNC-type coaxial receptacle when said antenna is in said fully retracted position and means for completing an electrical ground circuit to said BNC-type receptacle.

4. An antenna comprising: an antenna body telescopically extendable from a fully retracted position and having a free end; a BNC-type coaxial receptacle member mounted to the free end of said antenna body, said receptacle member including a tubular, electrically conductive inner electrode electrically coupled with the antenna body and defining an axial bore and a tubular, electrically conductive outer electrode coaxially surrounding said inner electrode; base means for mounting said antenna body to a radio, said base means including a cylindrical portion for telescopically mounting said antenna body and a receptacle portion for receiving said outer electrode member when the antenna body is in said fully retracted position; said outer electrode and said receptacle portion of said base means being in electrically conductive contact when said antenna body is in said fully retracted position so as to electrically ground said outer electrode; wherein said outer electrode is provided with an externally threaded portion and wherein said receptacle portion of said base means is provided with an internal thread surface for receiving said externally threaded portion of said outer electrode.

5. An antenna according to claim 4 wherein said base means includes a mounting member for mounting said cylindrical portion and said antenna body to a radio, and wherein said mounting member defines said receptacle portion of said base means, including said internal thread surface.

* * * * *